United States Patent [19]

Aoki et al.

[11] Patent Number: 4,516,335

[45] Date of Patent: May 14, 1985

[54] CLOTHES DRYER

[75] Inventors: Yoshiaki Aoki; Hazime Suzuki, both of Otsu; Tatsuya Hirota, Kyoto, all of Japan

[73] Assignee: Sanyo Electric Co., Ltd., Osaka, Japan

[21] Appl. No.: 480,486

[22] Filed: Mar. 30, 1983

[30] Foreign Application Priority Data

Apr. 9, 1982 [JP] Japan ..... 57-60156
Sep. 17, 1982 [JP] Japan ..... 57-162712
Sep. 20, 1982 [JP] Japan ..... 57-164753

[51] Int. Cl.[3] ..... F26B 11/04
[52] U.S. Cl. ..... 34/133; 34/242
[58] Field of Search ..... 34/133, 225, 233, 130, 34/132, 242

[56] References Cited

U.S. PATENT DOCUMENTS 2,503,329 4/1950 Geldhof et al. ..... 34/133
2,681,513 6/1954 Fowler ..... 34/133
2,851,790 9/1958 Worst ..... 34/133
2,875,996 3/1959 Hullar ..... 34/133
3,155,462 11/1964 Erickson et al. ..... 34/133
3,357,109 12/1967 Harvey ..... 34/133
3,364,592 1/1968 Nighswander et al. ..... 34/133
4,123,851 11/1978 Itoh et al. ..... 34/133

*Primary Examiner*—Larry I. Schwartz
*Attorney, Agent, or Firm*—Darby & Darby

[57] ABSTRACT

A clothes dryer comprising: a cabinet; a horizontal type rotary drum formed with a circular opening in its end face which is generally perpendicular to the peripheral wall of said drum; a drum supporting disc slidably fitted in the circular opening of said end face to support said horizontal type rotary drum and arranged in and supported by said cabinet generally coextensively with said end face, said drum supporting disc being formed with an air inlet and an air outlet; heater means; and blower means for supplying the hot air, which has been heated by said heater means, into said horizontal type rotary drum through said air inlet and for discharging the air in said horizontal type rotary drum to the outside of said rotary drum through said air outlet.

13 Claims, 20 Drawing Figures

CLOTHES DRYER

BACKGROUND OF THE INVENTION

The present invention relates to a clothes dryer for drying clothes in a horizontal drum by mounting the drum rotatably in a cabinet and by supplying heated air into the drum.

In recent years, a clothes dryer is frequently used such that it is combined with a washing machine and arranged above the same or such that it is arranged along the wall of a room. From the points of usability of the washing machine and/or effective use or harmony of the space of the room, there arises a tendency that the clothes dryer is desirably made thinner by reducing the depth of its cabinet. For this desire, a horizontal type rotary drum has to be necessarily made thinner because it occupies the compartment of the cabinet.

Nevertheless, in the clothes dryer of this kind according to the prior art, the heated air in the drum generally flows in the longitudinal direction of the drum, i.e., in the direction of the axis of rotation of the drum. With the heated air flowing in that direction, in case the drum is made thin by reducing its depth (i.e., taken in the longitudinal direction), its diameter, i.e., its vertical length is accordingly enlarged so as to prevent its capacity from being reduced. This invites a fear that the heated air may be discharged out of the drum before it fully occupies the space of the drum from up to down. In other words, the air inlet and outlet holes formed in the front and rear end faces of the drum have their sizes limited so that the heated air flows only through a portion of the drum chamber whereby the heat is not effectively consumed to deteriorate the drying efficiency (Reference should be made to U.S. Pat. No. 4,123,851 and British Pat. No. 1416881). Therefore, there has been conceived a construction in which the drum has its peripheral wall formed with a number of holes so that the heated air may flow therethrough vertically in the drum. According to this construction, the peripheral wall of the drum is formed with a number of holes for the heated air, these holes may become to be clogged with the clothes so that the heated air cannot flow smoothly. This may result in an extended drying operation and reduced drying efficiency (as is disclosed in Japanese Utility Model Publication No. 41-23679).

SUMMARY OF THE INVENTION

According to the present invention, there is provided a clothes dryer comprising: a cabinet; a horizontal type rotary drum formed with a circular opening in its end face which is generally perpendicular to the peripheral wall of said drum; a drum supporting disc slidably fitted in the circular opening of said end face to support said horizontal type rotary drum and arranged in and supported by said cabinet generally coextensively with said end face, said drum supporting disc being formed with air inlet and air outlet; heater means; and blower means for supplying the hot air, which has been heated by said heater means, into said horizontal type rotary drum through said air inlet and for discharging the air in said horizontal type rotary drum to the outside of said rotary drum through said air outlet.

According to the present invention, more specifically, by arranging the drum supporting disc coextensively with the end face of the horizontal type rotary drum and by forming the drum supporting disc with the air inlet and the air outlet, the heated air flows in a vertical direction perpendicular to the axis of the drum so that it can be spread over the whole chamber of the drum, even if the drum is made thin, as opposed to the prior art construction in which the heated air flows in the axial direction so that the hot air fails to be spread to the top and bottom of the drum, and the air inlet and outlet are less likely to be clogged with the clothes, because they are not formed in the peripheral wall of the drum, so that the ventilation can be improved to provide an excellent drying effect. Moreover, the air inlet and outlet (holes) can be simultaneously punched, because they are formed in the drum supporting disc, so that their machinings can be simplified.

According to the present invention, moreover, if the air inlet are formed in an upper portion of the drum supporting disc whereas the air outlet are formed in a lower portion of the same, the heated air is made liable to go into and out of the drum thanks to the flows of the air by the stirred clothes in the drum so that the air flow rate can be increased to further improve the drying effect. This leads to increase in the calorific value of the heater, if the construction uses a semiconductor heater having positive temperature coefficient as that heater, so that the improvement in the drying effect can be prominent.

By arranging the air outlet in the portion which is dislocated in the rotational direction of the drum from such a position as is symmetric by 180 degrees with the air inlet with respect to the center of the drum supporting disc, still moreover, the heated air is entrained at a high flow rate to impinge upon the clothes for a long time by the actions of the swirling air flows due to the rotations of the clothes within the drum so that the drying efficiency can be further improved. This effect is the more prominent as the drum is the thinner.

Preferably the internal diameter of the drum is three or four times of the depth.

Figure 1:
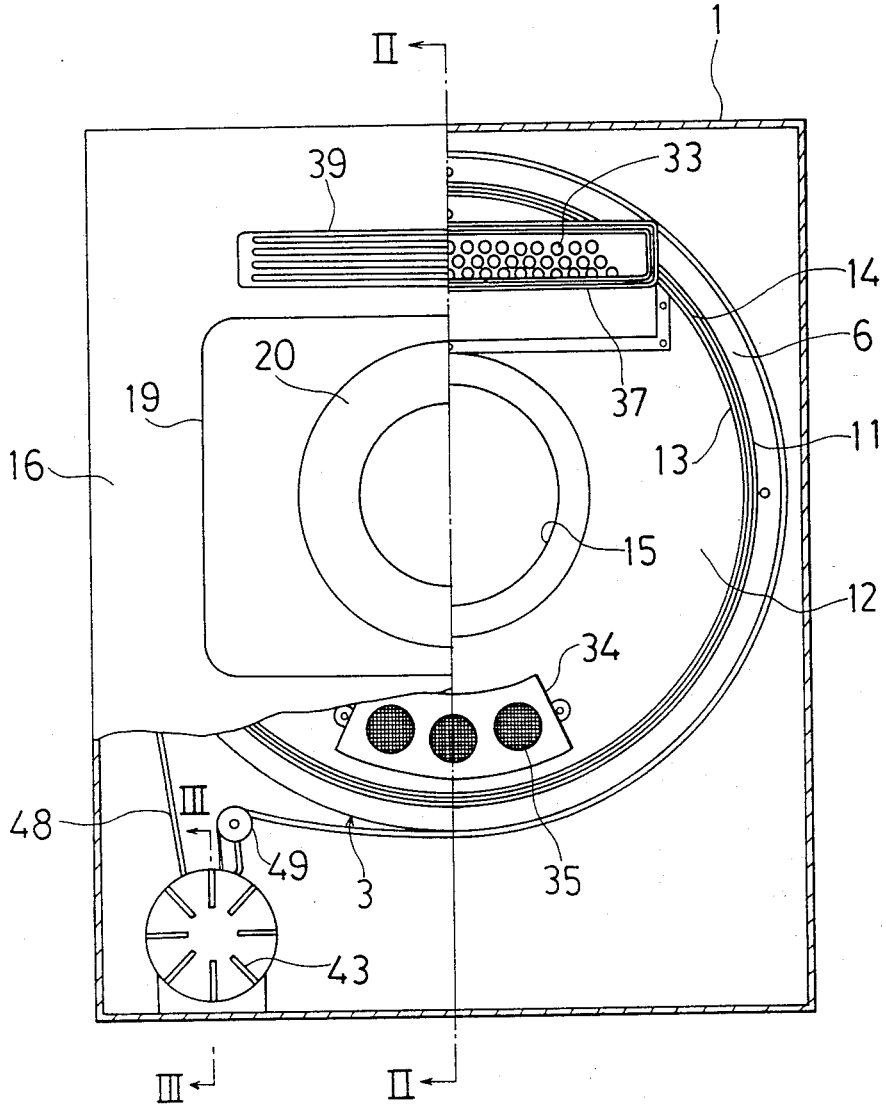
FIG. 1 is a front elevation showing a clothes dryer according to the present invention with the front face of a cabinet being partially cut away.

DESCRIPTION OF THE PREFERRED EMBODIMENTS (1) The present invention will be described in the following with reference to the accompanying drawings. First of all, reference numeral 1 appearing in FIGS. 1 and 2 indicates a cabinet which has its rear opening covered with a rear end plate 2 and in which a horizontal type rotary drum 3 for being loaded with clothes to be dried is rotatably mounted. The drum 3 has its peripheral wall 4 and rear end wall 5 made integrally of a synthetic resin such as polypropyrene. A front end plate 6 is secured to the front end of the peripheral wall 4. This peripheral wall 4 is formed integrally with a plurality of baffles 7 which protrude inwardly. The front end plate 6 is fastened to the front end portion of the baffles 7 by means of screws 8, and the portion of the front end plate 6 other than those fastened portions is fitted in a groove 9 which is formed in the front end of the peripheral wall 4 (As better seen from FIGS. 5 and 6).

Figure 5:
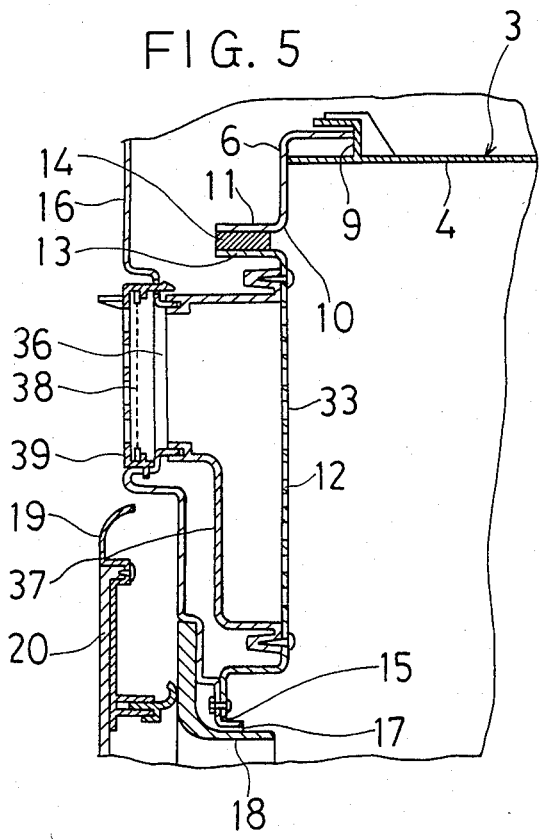
FIGS. 5 to 7 are sectional views showing the portions surrounded by circles V, VI and VII of FIG. 2 respectively, in enlarged scales.
Figure 6:
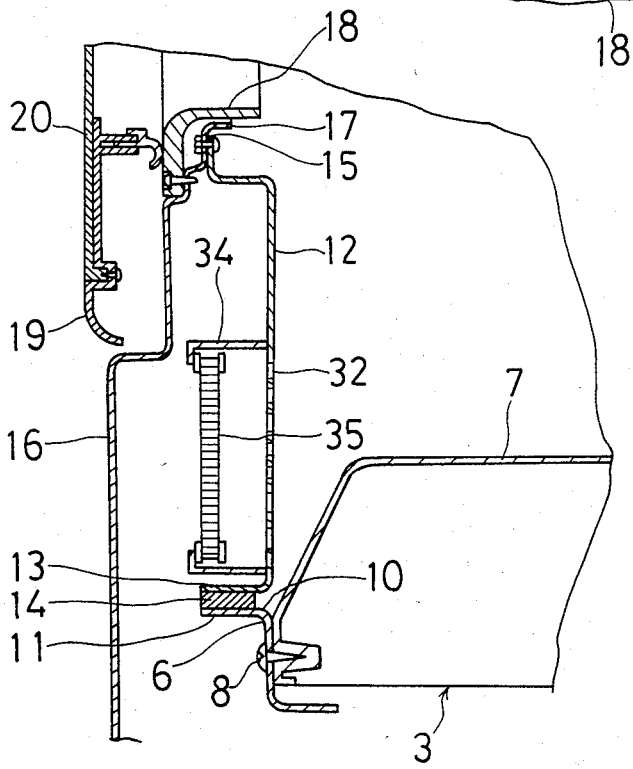
Figure 7:
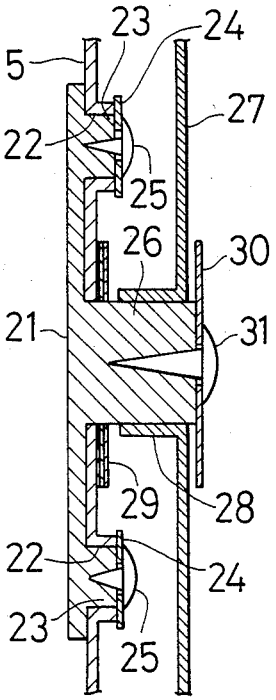

With reference to FIGS. 1 to 6, especially to FIGS. 5 and 6, that marginal flange 11 of the front end plate 6, which defines the front opening 10 of the drum 3, is fitted through a felt gasket 14 on the peripheral flange 13 of a drum supporting disc 12 which partitioning the inside of the drum 3 and the outside of the same within the cabinet. In addition to that felt, incidentally, an acetal copolymer (e.g. "Duracon", Trademark of Polyplastics Co., Ltd. Japan) can be also be used as the sliding gasket. The drum supporting disc 12 is formed into such an annular shape as has an opening at its center, and this central opening 15 is fastened by screws to the peripheral edge portion of a clothes loading opening 17 which is formed in a cabinet front end wall 16. The clothes loading opening 17 thus formed is covered with a protective cover 18 of a resilient synthetic resin and is opened and closed by a door 19. This door 19 has its front face made of a transparent member 20. A hub 21 made of a synthetic resin such as "Duracon" having a high wear resistance is secured to the central portion of the drum rear end wall 5, while being prevented from coming out, as shown in FIG. 7, by having its projections 23 fitted in a plurality of holes 22 formed in the rear end wall 5 and by driving tapping screws 25 into the projections 23 after washers 24 have been applied to the leading ends of the projections 23. The hub 21 thus secured has its central portion formed integrally with a rotary shaft 26 for the drum 3, which is fitted and journaled in a sleeve 28 formed integrally with a supporting plate 27. Before the rotary shaft 26 is inserted into the sleeve 28, a plurality of thrust washers 29 fitted on the rotary shaft 26. After the rotary shaft 26 has been inserted into the sleeve 28, a washer 30 is applied to the leading end of the shaft 26, and a tapping screw 31 is thrusted into the shaft 26 so that the shaft 26 is prevented from moving in the thrust direction as well as from coming out by the actions of the thrust washers 29 and the washer 30. The aforementioned supporting plate 27 is secured to the rear end at both the sides of the cabinet 1. Incidentally, the tapping screws 31 and 25 are so threaded in the direction opposite to the rotating direction of the drum that they may not become loose even if the drum 3 rotates. Thus, this drum 3 has its rear portion supported by fitting the rotary shaft 26 in the sleeve 28 and its front portion supported rotatably by fitting the marginal flange 11 of the front end plate 6 on the peripheral flange 13 of the drum supporting disc 12.

Here, the rotary shaft fixed at the back of the drum according to the prior art is made of metal so that the supporting plate requires bearing parts such as a plastic bearing or a ball bearing. If the rotary shaft 26 is made of a synthetic resin such as "Duracon", as has been described in the above, on the contrary, it is sufficient to form the sleeve 28 integrally with the supporting plate 27 so that the number of parts inclusive can be reduced, and it is also sufficient to thrust the tapping screw 31 so that the machining and assembly can be simplified.

With specific reference to FIGS. 5 and 6 the aforementioned drum supporting disc 12 is formed at its lower portion with a number of air inlet holes 32 and at its upper portion with a number of air outlet holes 33. At a position facing the air inlet holes 32 of the drum supporting disc 12, there are disposed heater mounting plates 34, in which several honeycomb shaped semiconductor heaters (thermisters) having positive temperature coefficient (see Japanese Published Examined Patent Application Nos. 48815/1976 and 1677/1980) 35 are mounted. On the other hand, the cabinet front end wall 16 has its upper portion formed with a discharge opening 36 which has communication with the air outlet holes 33 of the drum supporting disc 12 through an exhaust duct 37. That discharge opening 36 is fitted with a removable exhaust grill 39 which is lined with a filter screen 38.

Turning to FIGS. 1 to 4, the cabinet front end wall 16 is formed at its lower portion with an ambient air intake opening 40 which is fitted with a removable intake grill 42 lined with a filter screen 41. At a position facing the ambient air intake opening 40 within the cabinet, there is arranged a blower fan 43 which provides blower means. This fan 43 is secured to one end of the shaft 45 of a driving motor 44 which is installed on the bottom of the cabinet. The fan 43 has its rear wall formed with a cooling fan 46 for the motor 44. A smaller pulley 47 is secured to the end of the motor shaft 45. A belt 48 is made to run on that smaller pulley 47 and the peripheral wall of the drum 3 so that the rotations of the motor 44 are transmitted to the drum 3 through the smaller pulley 47 and the belt 48. This belt 48 has its tension adjusted by means of a tension pulley 49.

With the construction thus far described, when the motor 44 drives, the drum 3 is rotated together with the blower fan 43 so that the ambient air is sucked through the ambient air intake opening 40 into the cabinet 1 by the rotations of the fan 43 to raise the pressure in the cabinet to a higher level than the atmospheric pressure. Moreover, the air thus having its pressure raised is supplied to the heaters 35, which heat the air. This heated air flows into and ascends in the drum 3 so that it is exhausted through the aforementioned air outlet holes 33 to the outside of the drum until it is discharged by way of the exhaust duct 37 to the outside of the clothes dryer. Arrows appearing in FIG. 2 indicate the flows of the air at this time. While the heated air is ascending in the drum, the clothes are robbed of moisture so that they are dried.

Thus, in the clothes dryer, the heated air is made to flow from the lower portion to the upper portion of the front end of the drum 3. In case the drum is made thin, therefore, the heated air can be uniformly passed through the drum and from below to above, even if the drum has its diameter, i.e., the vertical size enlarged, so that the clothes can be efficiently robbed of the moisture contained therein while they are being stirred by the rotations of the drum to drop down from above to below against the flow of the heated air. Moreover, the air inlet and outlet holes 32 and 33 are not clogged with the clothes because they are not formed in the peripheral wall of the drum. As a result, a sufficient flow rate of wind can be ensured to provide an excellent drying efficiency.

Since the heated air is supplied and discharged from the front end side of the drum, on the other hand, the ambient air intake opening 40 and the discharge opening 36 to be formed in the cabinet become liable to be arranged in the front end of the cabinet. As a result, it is possible to clean without difficulty the intake grill 42 and the exhaust grill 39, which are mounted in the ambient air intake opening and the discharge opening, respectively.

Figure 2:
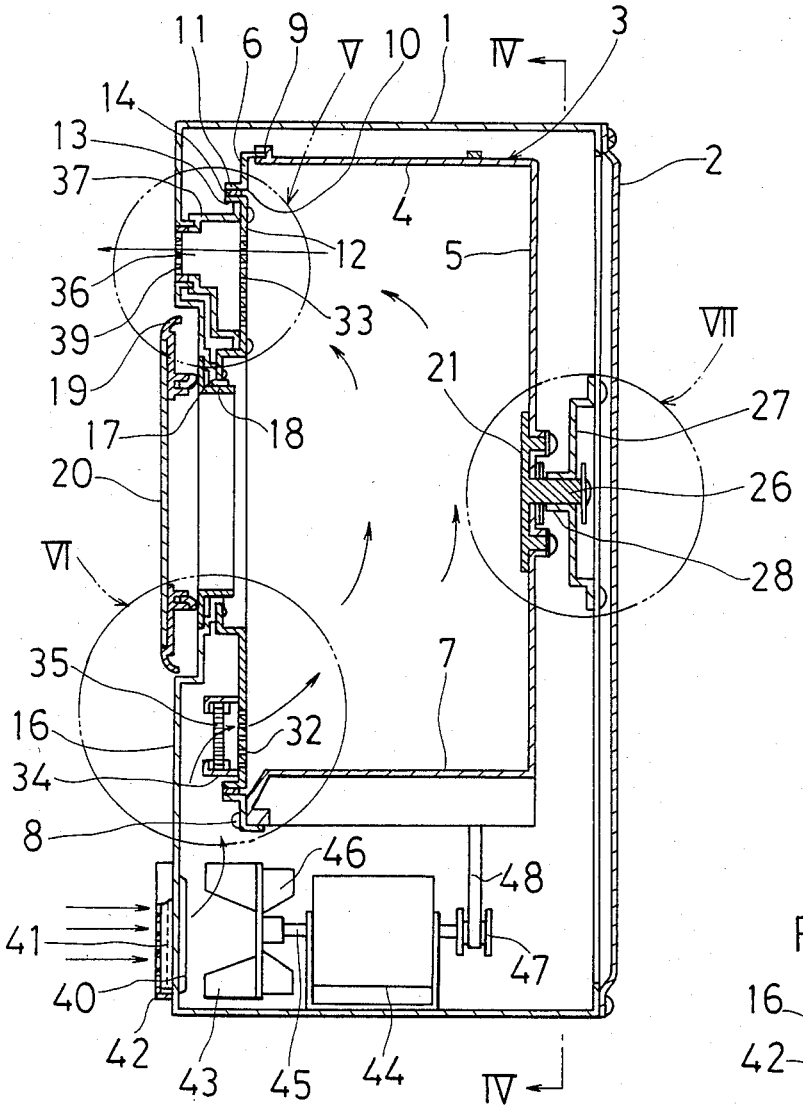
FIGS. 2 and 3 are sections taken along lines II—II and III—III of FIG. 1, respectively.
Figure 3:
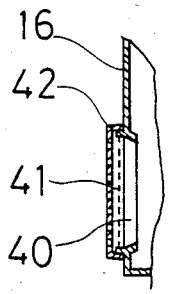
Figure 4:
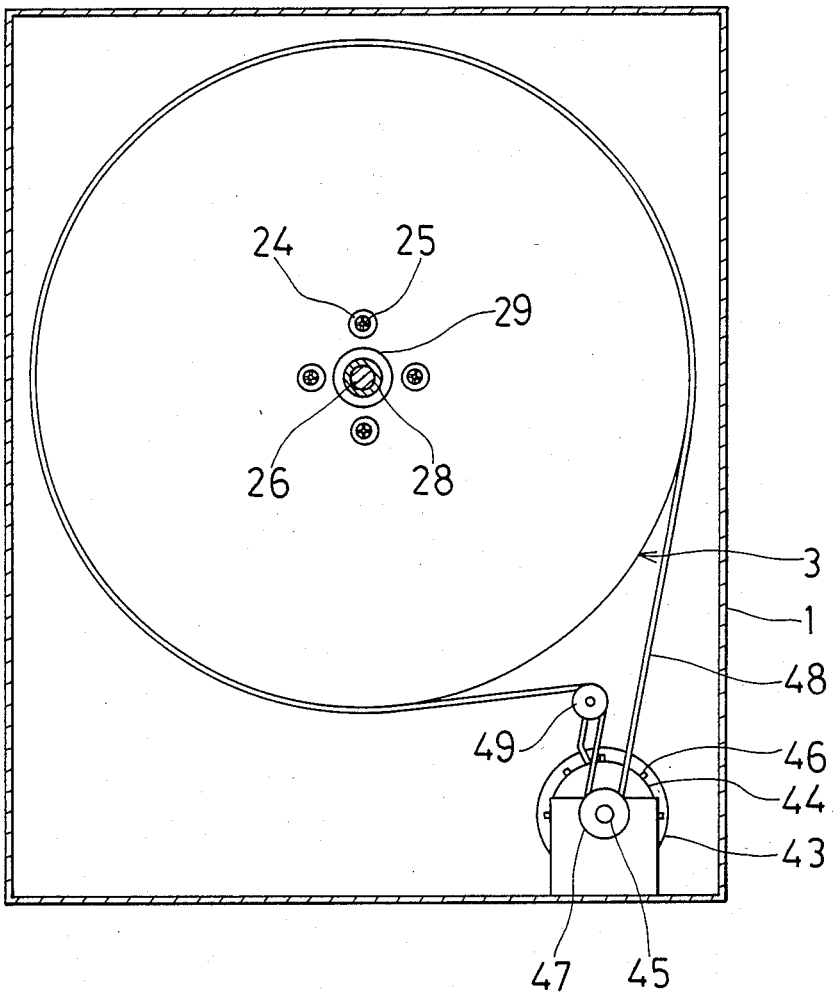
FIG. 4 is a section taken along line IV—IV of FIG. 2.
Figure 8:
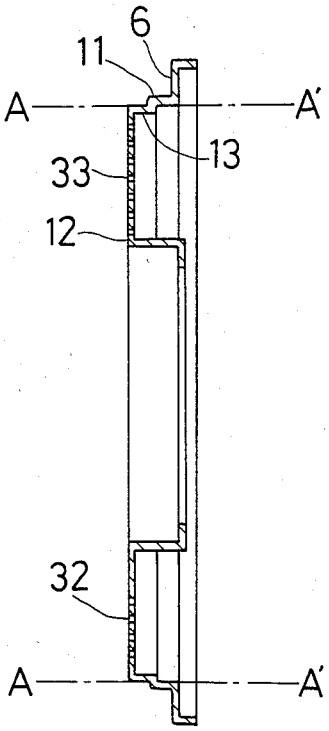
FIG. 8 is a longitudinal section showing the process of fabricating the drum front end plate and the drum supporting disc of FIG. 1.

FIG. 8 shows the relationship between the drum front end plate 6 and the drum supporting disc 12 when they are to be fabricated. Naturally, the two members 6 and 12 are integrally pressed, as shown, and are then cut along line A—A' of the drawing so that the outer side of the cutting line may be used as the front end plate 6 whereas the inner side may be used as the drum supporting disc 12. (If the cut inside portion is reversed, the state of the drum supporting disc 12 is achieved, as shown in FIG. 2.) By this fabrication, it is possible to reduce the number of the machining steps and the loss of the materials used.

Figure 9:
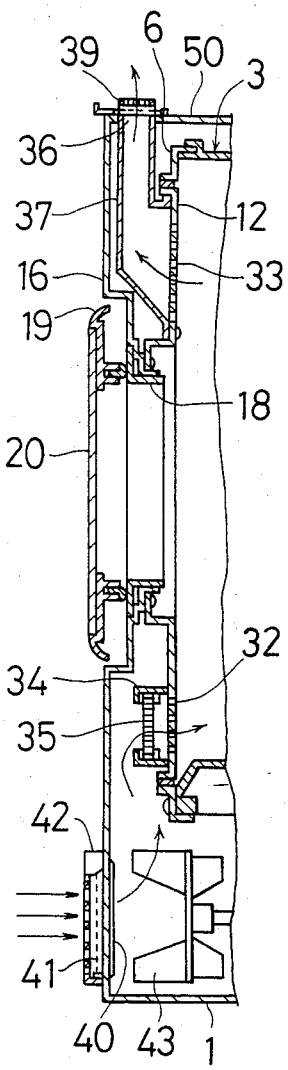
FIG. 9 is a longitudinal section showing the front portion of the cabinet of another embodiment.
Figure 10:
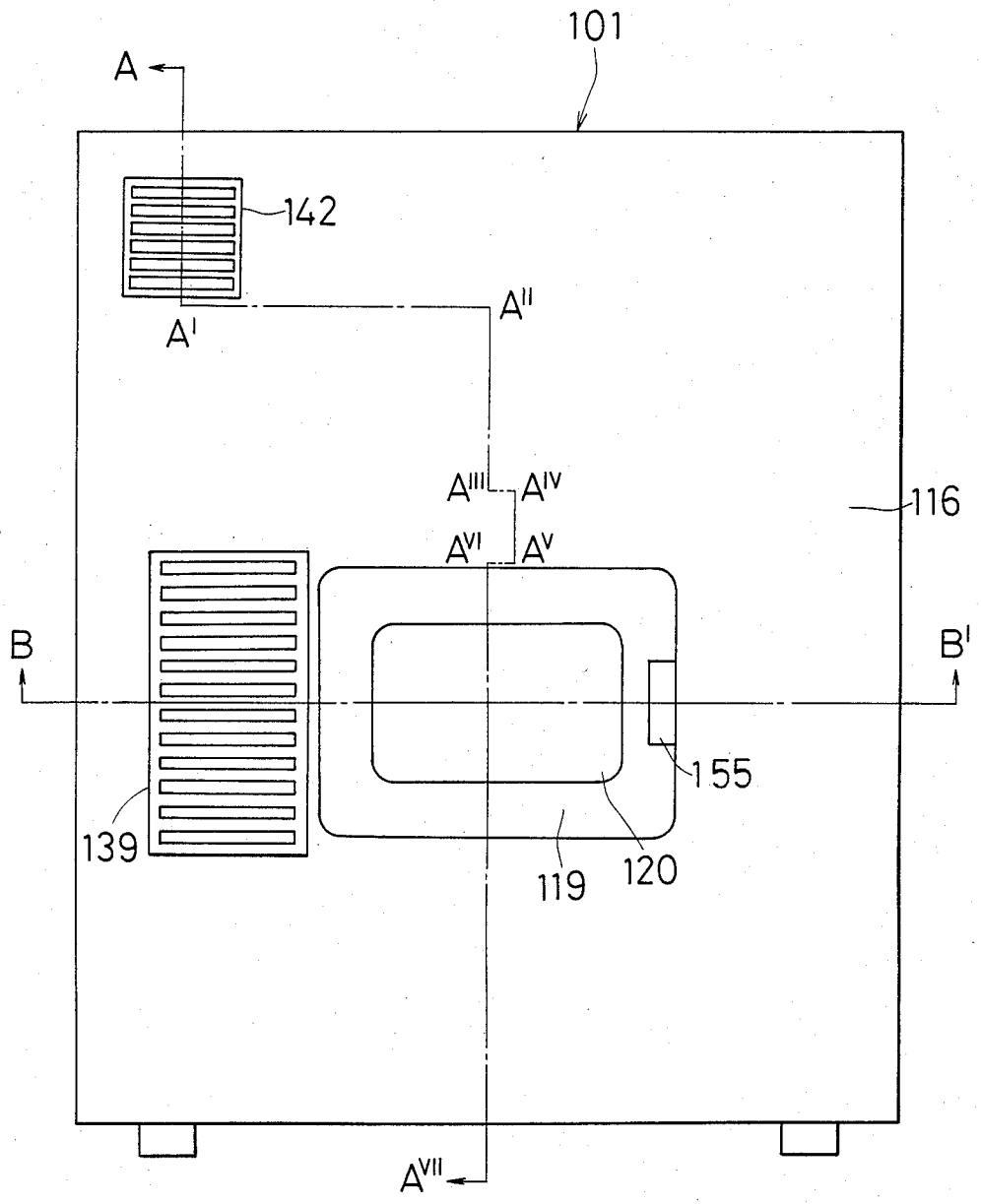
FIG. 10 is a front elevation showing another embodiment of the clothes dryer according to the present invention.
Figure 11:
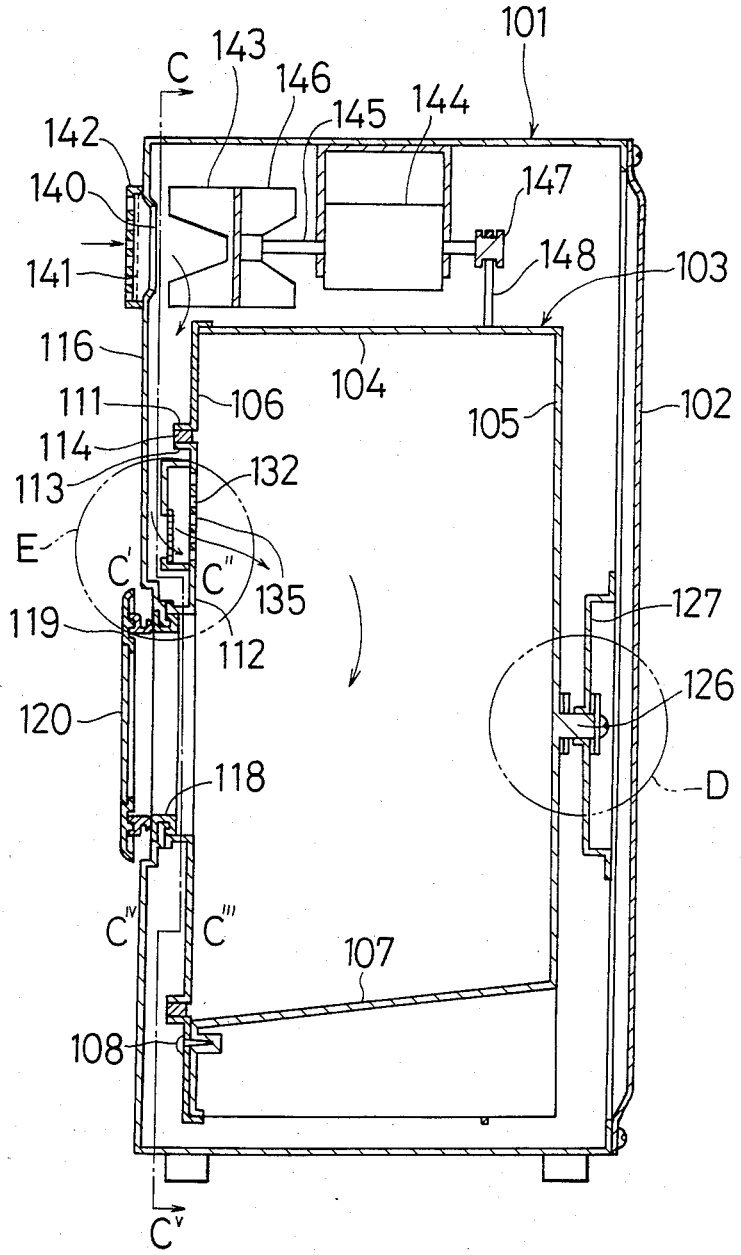
FIGS. 11 and 12 are sections taken along lines $A—A^{I}—A^{II}—A^{III}—A^{IV}—A^{V}—A^{VI}—A^{VII}$ and $B—B^{I}$ of FIG. 10, respectively.
Figure 12:
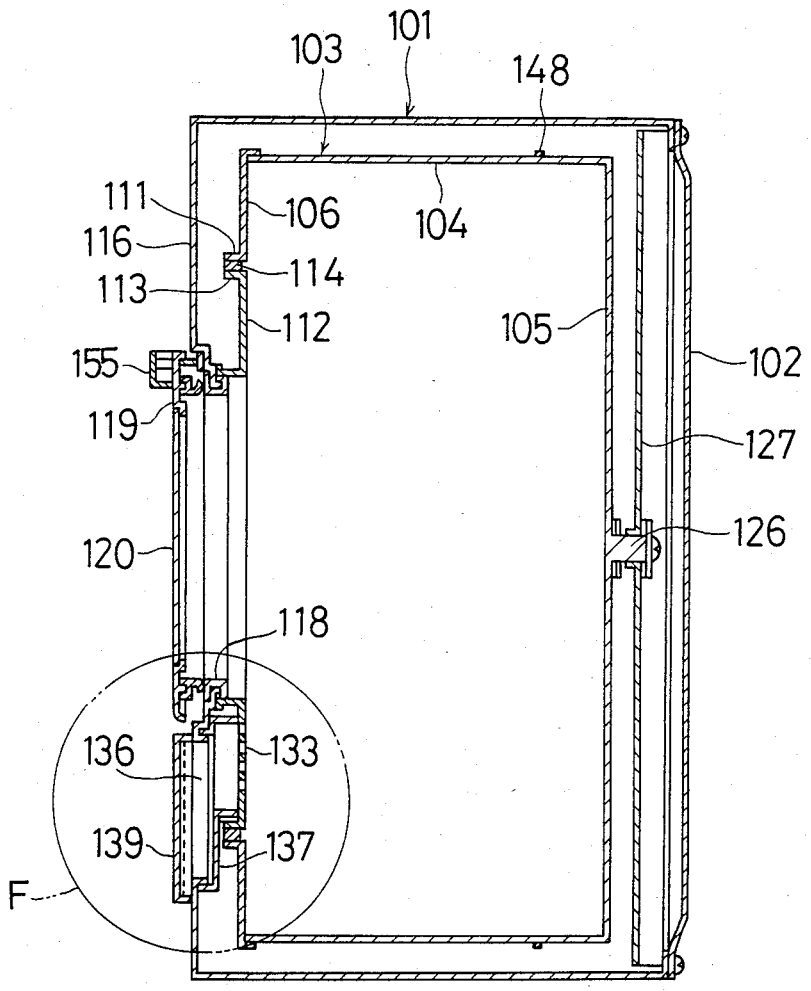
Figure 13:
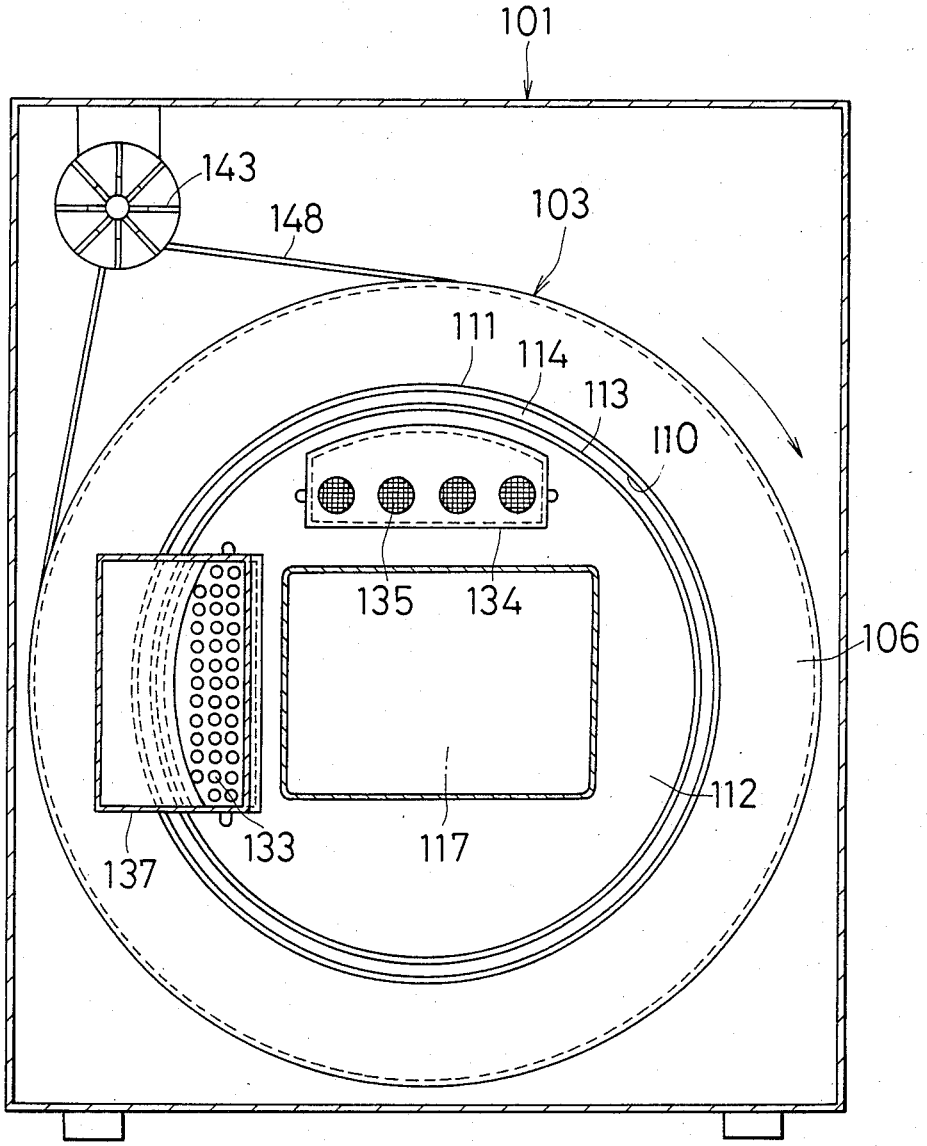
FIG. 13 is a section taken along line $C—C^{I}—C^{II}—C^{III}—C^{IV}—C^{V}$ of FIG. 11.
Figure 14:
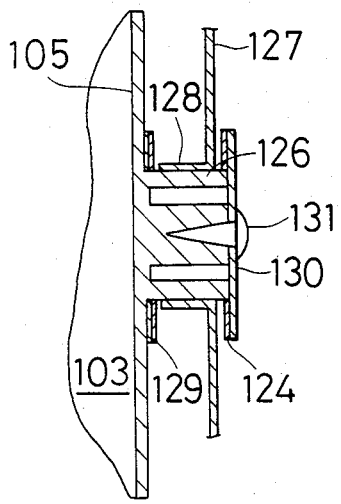
FIGS. 14 and 15 are enlarged views showing the portions surrounded by circles D and E of FIG. 11, respectively.
Figure 15:
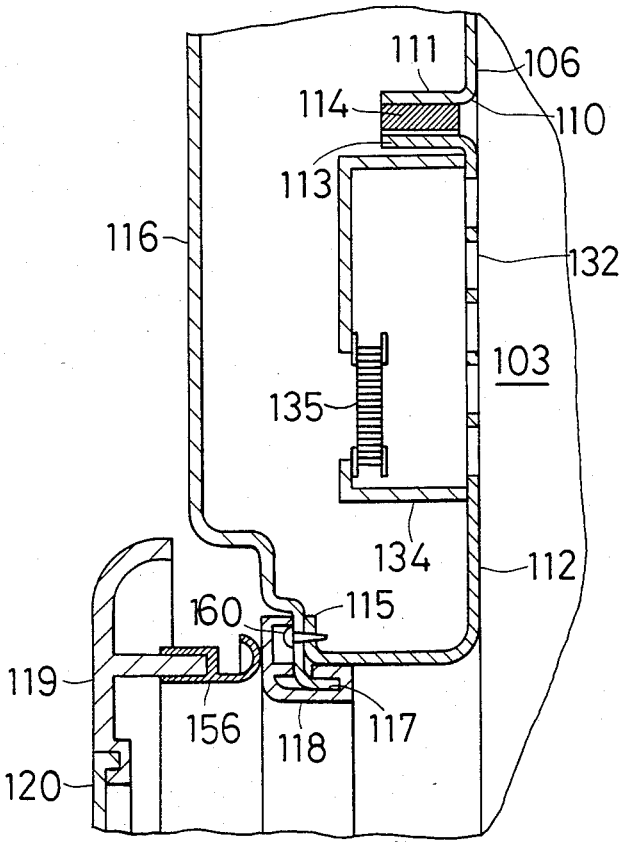
Figure 16:
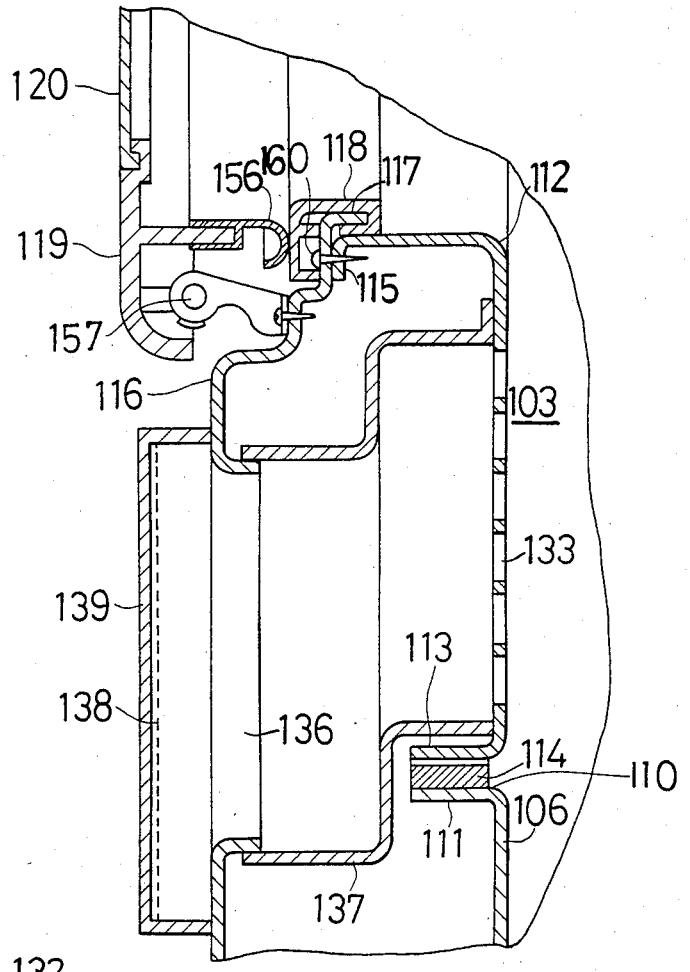
FIG. 16 is an enlarged view showing the portion surrounded by circle F of FIG. 12.

FIG. 9 shows another embodiment, in which the discharge opening 36 is formed in the ceiling 50 of the cabinet so that the heated air may be discharged upward out of the drum 3. In the same Figure, parts having the same functions as those of FIG. 2 are indicated at the same reference numerals. With this construction, since the exhaust duct 37 is directed upward, the resistance to the air to be exhausted can be reduced so that the air flow rate can be increased to further improve the drying efficiency.

According to the construction of the clothes dryer shown in FIGS. 1 to 9, as has been described hereinbefore, the heated air is supplied within the front opening of the drum from the lower portion to the inside of the drum and is exhausted from the upper portion. As a result, even in case the drum is made so thin that its depth is reduced but its diameter is enlarged, the heated air can be uniformly introduced into the drum to have its heat exchange with the moisture content in the clothes so that a sufficient flow rate can be ensured to provide an excellent drying efficiency. As a result, the drum and accordingly the cabinet can be made thin. There can be attained another excellent effect that the ambient air intake opening and the discharge opening to be formed in the cabinet can be arranged with more ease in front of the body so that their maintenances and inspections can be facilitated.

Incidentally, if the ambient air is sucked through its intake opening so that the pressure in the cabinet may be raised to supply the drum with the heated air, as in the present embodiment, no intake duct is required from the ambient air intake opening to the air inlet holes of the drum so that the reduction in the thickness of the cabinet can be accordingly promoted. Moreover, the air inlet and outlet holes can be simultaneously punched, because they are formed in the drum supporting disc, so that their machining can be facilitated.

(2) Next, another embodiment of the present invention will be described in the following with reference to FIGS. 10 to 17. The major point different from the foregoing embodiment resides in the positional relationship between the air inlet holes and outlet holes of the drum supporting disc. The following description is directed mainly to that point.

Specifically, the drum supporting disc 112 is formed with a number of air outlet holes 133 at the position which is dislocated by 90 degrees in the rotational direction of the drum from such a position as is symmetric by 180 degrees with the aforementioned air inlet holes renumbered at 132 with respect to the center of the drum supporting disc 112, namely, the lower portion of the drum supporting disc 112. Here, the rotations of the drum 103 are taken in the direction of arrow, as viewed in FIG. 13.

Figure 17:
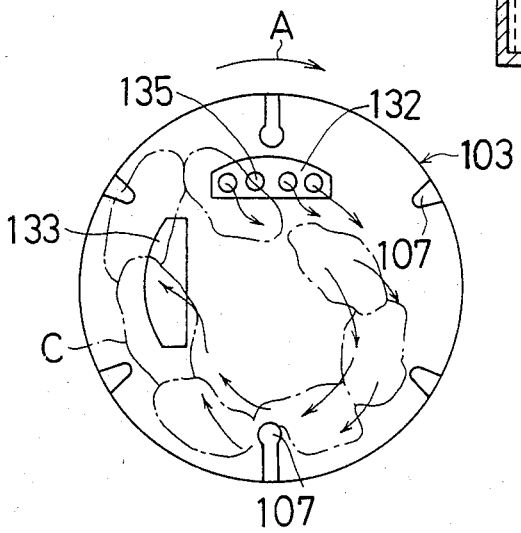
FIG. 17 is an operation explaining view showing the air flows in the drum.

Thus, the clothes C in the drum 103 drop down, after they have been once scooped up or lifted by the baffles 107 in accordance with the rotations of the drum, so that the air flow along the movements of the clothes, i.e., in the rotational direction of the drum 103 (or in the direction of arrow A in FIG. 17) is established within the drum 103 by the movements of the clothes. As a result, the heated air coming from the aforementioned air inlet holes 132 is entrained to advance in the directions of arrows of FIG. 17 by the rotating air flow within the drum. Here, since the clothes are fewer at the upper portion of the drum space than at the lower portion and since the aforementioned air inlet holes 132 are formed in that upper portion having fewer clothes, i.e., in the upper portion of the drum supporting disc 112, those air inlet holes 132 are reluctant to be clogged with the clothes so that much heated air is entrained by the aforementioned rotating air flow within the drum to steal into the drum and impinge upon the clothes. Moreover, since the air outlet holes 133 are located at the position which is dislocated by 90 degrees in the rotational direction from just below the drum supporting disc 112 (i.e., from the position symmetric by 180 degrees with the air inlet holes 132 with respect to the center of the drum supporting disc), the distance the hot air travels from the air inlet holes 132 to leave the air outlet holes 133 is lengthened so that the heated air impinges at a high rate upon the clothes for a long time to sufficiently contribute to the evaporation of the moisture contained until it is exhausted to the outside of the drum. As a result, the clothes can be efficiently dried. Especially as the drum becomes the thinner, the actions of the rotating air flow following the movements of the clothes within the drum become the more prominent so that they can exhibit their effects the better. In FIG. 17, incidentally, the numerous air inlet and outlet holes are generally shown to generally accord to their respective contours.

In the foregoing embodiments including that having been described in (1), the air inlet and outlet holes 132 and 133 are formed in the drum supporting disc 112 within the front opening of the drum. In case the rear end of the drum is made to have a similar shape to that of the front end, however, those air inlet and outlet holes may be formed in the drum supporting disc within the rear opening of the drum.

On the other hand, in the clothes dryer using semiconductor heaters 135 as its heater means, the calorific value is increased the more according to the positive temperature coefficient of the heaters as the flow rate of the air passing through the heaters becomes the more. As a result, if the heated air is introduced at a high flow rate into the drum by making use of the rotating air flow within the drum, the flow rate of the air to pass through the heaters can be increased to increase its calorific value.

Incidentally, the ambient air intake opening 140 of a cabinet front end 116 is formed in the corner of the upper portion, as is different from the embodiment of FIGS. 1 to 7, and a centrifugal fan 143, a motor 144 and their cooling fan 146 are accordingly arranged at the upper portion. Moreover, the baffles 107 are so inclined that their height is gradually increased from the front end to the rear end of the drum. Reference numeral 156 indicates a packing which is sandwiched between a protective cover 118 and door 119 to prevent the air leakage in-between. Numerals 155 and 157 indicate the knob of the door 119 and a pivot on which the door is to be opened and closed, respectively.

According to the clothes dryer shown in FIGS. 10 to 17, as has been described hereinbefore, air inlet holes through which the heated air is introduced into the drum are formed in such an upper portion within the end opening of the drum as is reluctant to be clogged with the clothes, and the air outlet holes are formed at such a position within the end opening of the drum as is dislocated in the rotational direction of the drum from the position symmetric by 180 degrees with the air inlet holes with respect to the center of the drum supporting disc. As a result, by making use of the rotating air flow established within the drum, the heated air is introduced at a high rate into the drum, and the distance for the heated air to flow until it leaves the air outlet holes is elongated so that the heated air having stolen into the drum during that period can be made to sufficiently contribute to the drying operation. Especially in case the drum is made so thin that its depth is reduced but its diameter is enlarged, the action of the rotating air flow in the drum becomes so prominent that a sufficiently excellent drying efficiency can be obtained even if the drum is made thin.

Figure 18:
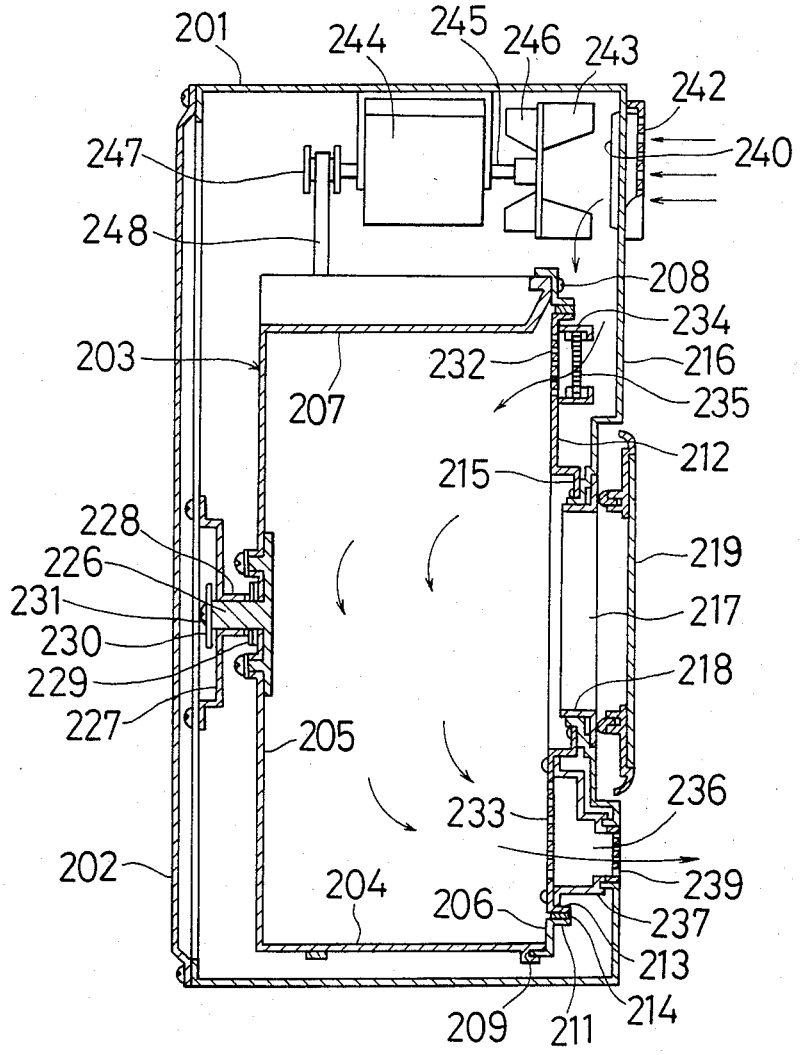
FIG. 18 is a longitudinally sectional side elevation showing still another embodiment of the clothes dryer of the present invention.
Figure 19:
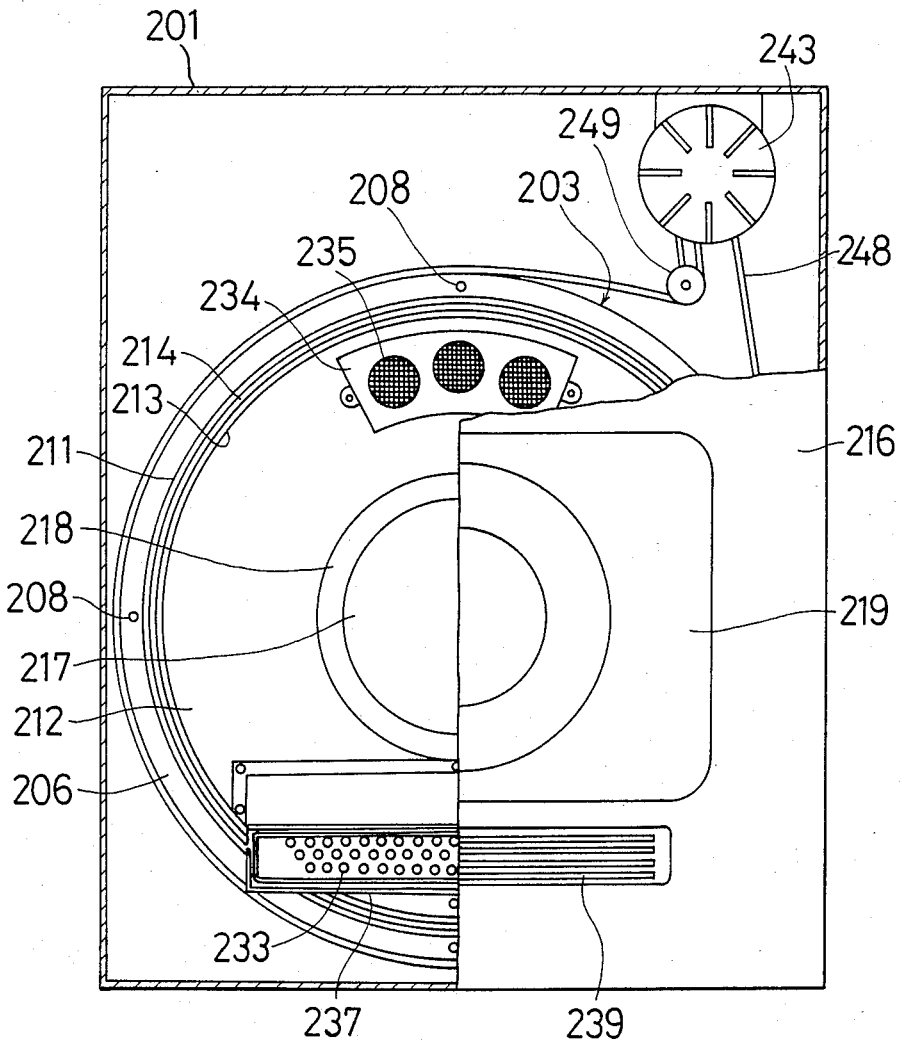
FIG. 19 is a front elevation of the same with its portion being broken away.

(3) Still another embodiment shown in FIGS. 18 to 19 is directed to the construction in which the vertical relationship between the air inlet and outlet holes of the drum supporting disc in the foregoing embodiment shown in FIGS. 1 to 7 is turned upside down. Specifically, air inlet holes 232 and air outlet holes 233 are formed in the upper and lower portions of a drum supporting disc 212, respectively, and an ambient air intake opening 240 and a discharge opening 236 are naturally accordingly formed in the upper and lower portions, respectively, with the remaining construction being left similar to that of the embodiment shown in FIGS. 1 to 7.

Thus, the clothes within a drum 203 drop down after they have been once scooped up by the actions of baffles 207 in accordance with the rotations of the drum so that the flow of the air within the drum is directed downward in accordance with the drop of those clothes. More specifically, the air flows upward at a portion wherein the clothes are scooped up, but the dropping speed is higher than the lifted speed so that the downward air flow is strengthened as a whole. On the other hand, the clothes within the drum are fewer at the upper portion than at the lower portion.

In the embodiment under consideration, contrarily, the air inlet holes 232 are reluctant to be clogged with the clothes because they are formed in the upper portion of the drum supporting disc 212, i.e., in the upper portion within the drum. Moreover, the heated air is introduced at a high rate into the drum through the air inlet holes 232 by the entrainment of the downward air flow within the drum. At the same time, the heated air thus introduced leaves the air outlet holes 233 which are formed in the lower portion of the drum. Thus, the discharge of the air from the air outlet holes 233 is promoted by the wind pressure which is caused by the clothes dropping down.

As a result, the heated air is liable to enter and leave the drum so that its flow rate, namely, the flow rate of the air to pass through a plurality of honeycomb-shaped semiconductor heaters 235 having positive temperature coefficient is increased to improve the drying efficiency. Especially since the heated air flows downward in the vertical direction within the drum, it is effectively spread over the drum space in case the drum is made thin to have a reduced depth but an enlarged diameter.

Figure 20:
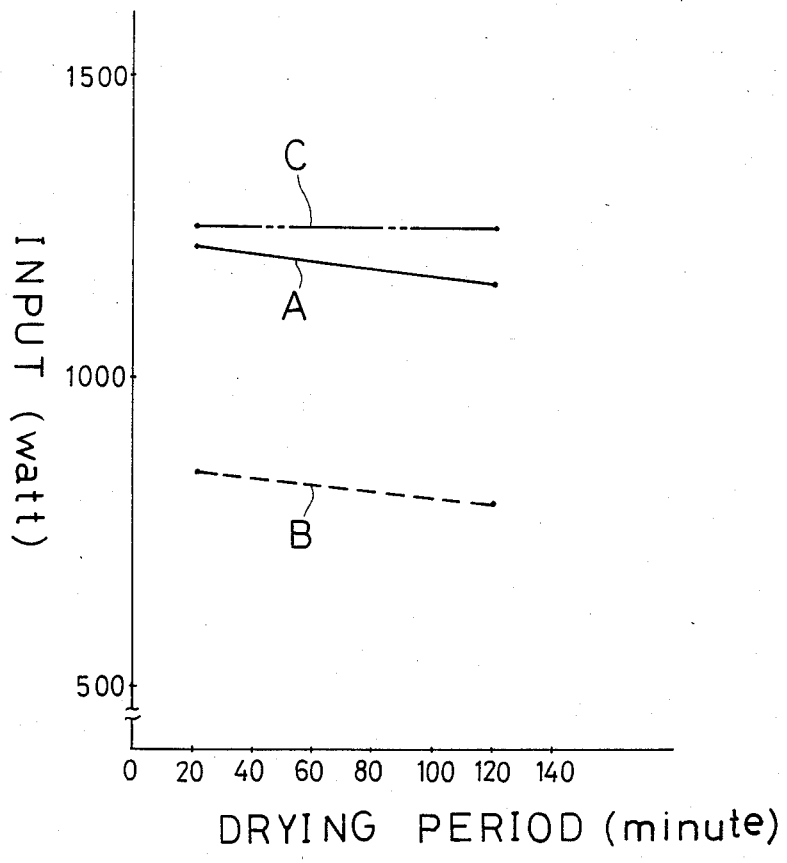
FIG. 20 is a graph illustrating the input characteristics of a heater for the difference in the positions of the air inlet and outlet holes and for the presence and absence of a load.

FIG. 20 illustrates the input states of the semiconductor heaters of positive temperature coefficient in case that the air inlet and outlet holes are so positioned as is shown in FIGS. 18 and 19 and in case in the case of FIGS. 1 to 7, in which the clothes dryer of the present invention is turned upside down to invert the positional relationship between the air inlet and outlet holes. In case the inlet holes are located at the upper portion whereas the outlet holes are located at the lower portion, a high input value results, as indicated by a curve A, to indicate that the draft to the heater is much so that the calorific value is high. It is found that the case of the curve A can enjoy a higher drying effect than the case indicated by a curve B, in which the air inlet holes are below whereas the air outlet holes are above.

In the state of no load in which the drum is not loaded with any clothes, no air flow is established by the clothes. As a result, an identical input value is obtained, as indicated by a curve C, irrespective of the vertical positions of the air inlet and outlet holes, and no resistance is established by the clothes so that the highest input value is obtained even for the most air flow. Incidentally, the fact that the input value becomes the lower as the drying period elapses, as indicated by the curves A and B, seems to come from the increase in the resistance to the wind through the drum as the clothes are dried to bulge.

According to the clothes dryer shown in FIGS. 18 and 19, as has been described hereinbefore, the air inlet and outlet holes are respectively formed in the upper and lower portions of the drum supporting disc, which slidably fits therein the front opening portion of the drum, so that the air inlet holes are made reluctant to be clogged with the clothes. Moreover, the flow of the air to be established by the drop of the clothes within the drum is used to make the heated air liable to enter the drum through the air inlet holes and leave the air outlet holes so that the heated air can flow downward at a high flow rate within the drum. As a result, the calorific value of the semiconductor heaters is so increased that ample calory can be transferred to the clothes to evaporate the moisture contained thereby to improve the drying efficiency. This effect is prominent especially in case the drum is made thin because the heated air can flow through the whole area of the drum space.

(4) Here, an example of the size specification of the clothes dryer shown in FIGS. 1 to 7 is presented for illustrative purposes only. Incidentally, values of the prior art are present in parentheses.

| | |
|---|---|
| Clothes Drying Capacity: | 2.5 kg (2.5 kg) |
| Standard | |
| Cabinet Size: | |
| Height | 670 mm (600 mm) |
| Width | 756 mm (686 mm) |
| Depth | 304 mm (436 mm) |
| Specifications of Horizontal Type Rotary Drum: | |
| Internal Diameter | 640 mm (567 mm) |
| Depth | 204 mm (301 mm) |
| R.P.M. (No Load) | 44 r.p.m. (53 r.p.m.) |
| Drum Supporting Disc: | |
| Air Inlet Holes | 3.7Ø × 936 (- - -) |
| Air Outlet Holes | 7.5Ø × 182 (- - -) |
| Temperature of Heated Air: (i.e., Difference from Room Temperature) | 100° C. (- - -) |

What is claimed is:

1. A clothes dryer comprising:

a cabinet;

a horizontal type rotary drum having a peripheral wall and front and rear walls which are generally perpendicular to the peripheral wall, one of the front or rear walls having a main opening formed therein;

a stationary drum supporting disc slidably fitted in the main opening and arranged in and supported by said cabinet generally coextensively with said front or rear wall, said drum supporting disc being formed with an air inlet and an air outlet;

heater means for heating air; and blower means for supplying air heated by the heater means into said drum through said air inlet and for discharging the air in said drum to the outside of said drum through said air outlet, said cabinet being formed with an ambient air intake opening and a discharge opening, said cabinet including a duct interposed between the discharge opening and the air outlet of the drum supporting disc, whereby after the ambient air has been sucked from said intake opening by the action of said blower means to raise the pressure in said cabinet to a higher level than the atmospheric pressure, the air in said cabinet is heated by said heater means so that the heated air is supplied to said horizontal type rotary drum.

2. A clothes dryer as defined in claim 1, wherein a portion of the front or rear wall is removed to form the main opening, and wherein the drum supporting disc is formed from the portion removed from the front or rear wall.

3. A clothes dryer as claimed in claim 1, wherein said air inlet is formed in an upper portion of said drum supporting disc whereas said air outlet is formed in a lower portion of the same disc.

4. A clothes dryer as claimed in claim 1, wherein said air outlet is formed in the position which is dislocated in the rotational direction of said horizontal type rotary drum from such a position as is symmetric by 180 degrees with said air inlet with respect to the center of said drum supporting disc.

5. A clothes dryer as claimed in claim 3, wherein said air outlet is formed in the position which is dislocated in the rotational direction of said horizontal type rotary drum from such a position as is symmetric by 180 degrees with said air inlet with respect to the center of said drum supporting disc.

6. A clothes dryer as claimed in claim 4, wherein said air outlet is formed in the position which is dislocated by 270 degrees in the rotational direction of said horizontal type rotary drum from said air inlet with respect to the center of said drum supporting disc.

7. A clothes dryer as claimed in claim 5, wherein said air outlet is formed in the position which is dislocated by 270 degrees in the rotational direction of said horizontal type rotary drum from said air inlet with respect to the center of said drum supporting disc.

8. A clothes dryer as claimed in claim 1, wherein said heater means is a semiconductor heater having positive temperature coefficient.

9. A clothes dryer as claimed in claim 3, wherein said heater means is a semiconductor heater having positive temperature coefficient.

10. A clothes dryer as claimed in claim 1, wherein said drum supporting disc is formed generally at the center thereof with an opening for clothes passage in addition to said air inlet and said air outlet and wherein said cabinet is formed in its front end with a clothes charging and discharging opening which has its peripheral edge fitted in the clothes passage opening of said drum supporting disc.

11. A clothes dryer as claimed in claim 1, which further includes a felt member interposed between the drum supporting disc and the front or rear wall of the drum in which the main opening is formed.

12. A clothes dryer as claimed in claim 10, which further includes a felt member interposed between the drum supporting disc and the front or rear wall of the drum in which the main opening is formed.

13. A clothes dryer as claimed in claim 1, wherein said drum has a size of the internal diameter which is three or four times of the depth.

* * * * *